US006568800B1

(12) United States Patent
Langley

(10) Patent No.: US 6,568,800 B1
(45) Date of Patent: May 27, 2003

(54) INK RESERVOIR FOR INK-JET PRINTER

(75) Inventor: Andrew Langley, 333 Blantyre Avenue, Scarborough, Ontario (CA), M1N 2S6

(73) Assignee: Andrew Langley, Scarborough (CA)

( * ) Notice: Subject to any disclaimer, the term of this patent is extended or adjusted under 35 U.S.C. 154(b) by 918 days.

(21) Appl. No.: 08/871,898

(22) Filed: Jun. 9, 1997

(51) Int. Cl.[7] ..... B41J 2/175
(52) U.S. Cl. ..... 347/86
(58) Field of Search ..... 347/84, 85, 86, 347/87; 222/105

(56) References Cited

U.S. PATENT DOCUMENTS 4,053,901 A 10/1977 Skafvenstedt et al. ..... 347/85
4,183,031 A 1/1980 Kyser et al. ..... 347/86
4,419,678 A 12/1983 Kasugayama et al. ..... 347/86
4,586,635 A 5/1986 Collins, Jr. ..... 222/94
5,359,356 A * 10/1994 Ecklund ..... 347/86
5,611,461 A * 3/1997 Kubota et al. ..... 222/105
5,699,936 A * 12/1997 Sakamoto ..... 347/86

* cited by examiner

*Primary Examiner*—Anh T. N. Vo
(74) *Attorney, Agent, or Firm*—Anthony Asquith & Co.

(57) ABSTRACT

A replaceable ink reservoir for an inkjet printer includes a bag of flexible plastic film. The film is stretched over a plastic plug formed as a thick disc, and an annular ring is pressed over the plug, trapping the film therebetween. The grip achieved by this mode of fastening is secure enough for mechanical strength, and tight enough to seal the ink contained in the bag. No adhesives etc are needed. A needle-pierceable membrane is housed in the plug.

14 Claims, 3 Drawing Sheets

INK RESERVOIR FOR INK-JET PRINTER

BACKGROUND TO THE INVENTION

This invention relates to computer-operated printers of the kind that direct a jet of ink onto a passing surface. The invention is mainly intended for use on the kind of ink-jet printer in which the surface to be printed is a small distance away from the ink jet head, i.e the type that is used for printing onto cardboard boxes and the like. In such printers, the (liquid) ink reservoir is in the form of a flexible bag, and the bag is replaceable. The invention is aimed at providing an improved replaceable reservoir.

Previous designs of replaceable reservoirs for ink-jet printers have been based on the principle of sealing the ink in a container and of including a membrane as a portion of the wall of the container. A hollow needle fixed into the printer is arranged to mechanically pierce the membrane when the container, full of ink, is assembled into place in the printer. Ink flows into the printer through the hollow needle, and the membrane material is such as to seal itself around the needle, whereby no ink can leak out.

Both when the full container is assembled to the needle, and when the (nearly) empty container is removed from the needle, the membrane provides an adequate seal around the needle, and the membrane closes itself up, i.e seals itself, after the needle has been removed. The ink reservoir as described herein also is adapted to make use of the needle-and-membrane technology.

THE PRIOR ART

Some previous designs of ink reservoirs for ink-jet printers that might be considered relevant to the invention are: U.S. Pat. No. 5,359,356 (Ecklund, October 1994); U.S. Pat. No. 4,183,031 (Kyser, January 1980); and U.S. Pat. No. 4,053,901 (Skafvenstedt, October 1977).

THE INVENTION IN RELATION TO THE PRIOR ART

One previous design approach to the replaceable reservoir has been to use a container having fixed or rigid walls. Such containers have been expensive, especially since, as the ink is used, some means of compensating for the reduced volume in the container has to be provided. Movable pistons, which require to be sealed, have added to the complexity and expense. Of course, such systems can be engineered to be leakproof, even if the components are subjected to abusive treatment, but the expense of achieving robust leak-proof reliability has been high.

Another approach has been to provide a flexible bag, which can collapse as the ink is consumed. This addresses the moving-parts problem, but raises the problem of how the bag might be attached to the base component, or plug, in which the membrane is located. The problem of sealing a bag of thin flexible film to a solid, chunky plug, has not previously been resolved adequately, but inexpensive manner. Too often, the joint between bag and plug has been prone to leakage, even when (expensive) care and attention is given especially to the potentially-leaky region of the reservoir during manufacture. Previous designs have included welding, adhesives of various types, and so on, in the attempt to provide a reliable seal.

The invention provides a manner of attaching a bag of flexible plastic film to a chunky, solid plug. Basically, the bag is held tightly between the plug and a tightly fitting ring.

The ring holds the film material trapped between itself and the plug. As will be explained, assembly of this manner of attachment, on the production line, is simple enough that even an operator who carries out the assembly with a less than ideal degree of care and attention can readily produce reservoir after reservoir in which the chances of leakage are virtually nil. This level of reliability of the seal is achieved despite the fact that no adhesives or welding are needed.

For an effective seal, the ring should grip the film of the bag very tightly around the plug. The designer should see to it that the ring is of such dimensions as to support the stresses induced by the tight fit. The designer should have it in mind that plastic materials tend to settle or creep over a period of time, to a new dimension in which the stress is reduced. Thus, even though a badly-designed ring might produce a tight fit at first, such a ring might gradually "give" slightly, and the tight fit would be relaxed. The stresses induced in the ring must be kept low enough that the tight fit can be maintained indefinitely. Therefore, the ring and the plug should be thick and chunky.

It is recognised that a plug and a ring of such suitable dimensions as to hold the tight fit more or less indefinitely can be provided inexpensively, and can be accommodated within the environment available for a replaceable ink-reservoir on an ink-jet printer.

SUMMARY OF THE INVENTION

The invention lies in an ink-storage reservoir apparatus for a printer that includes a bag of flexible plastic film. A plug serves to close a mouth of the bag, and thereby to define an ink container in the bag. The plug has an outward-facing surface, and the mouth of the bag is placed thereover, and the surface of the plug is so dimensioned, in relation to the mouth of the bag, as to cause the material of the mouth of the bag to stretch over the plug. The apparatus includes a ring, and the ring has an inward-facing surface, which is complementary to the outward-facing surface of the plug. The ring is a tight interference fit over the material of the mouth of the bag when the mouth of the bag is stretched over the outer surface of the plug. The ring is pressed over the plug and encircles the plug, and serves to grip the material of the mouth of the bag, tightly and securely, between the outward-facing surface of the plug and the inward-facing surface of the ring.

BRIEF DESCRIPTION OF THE DRAWINGS

By way of further explanation of the invention, exemplary embodiments of the invention will now be described with reference to the accompanying drawings, in which.

DETAILED DESCRIPTION OF THE PREFERRED EMBODIMENTS

The apparatuses shown in the accompanying drawings and described below are examples which embody the invention. It should be noted that the scope of the invention is defined by the accompanying claims, and not necessarily by specific features of exemplary embodiments.

Figure 1:
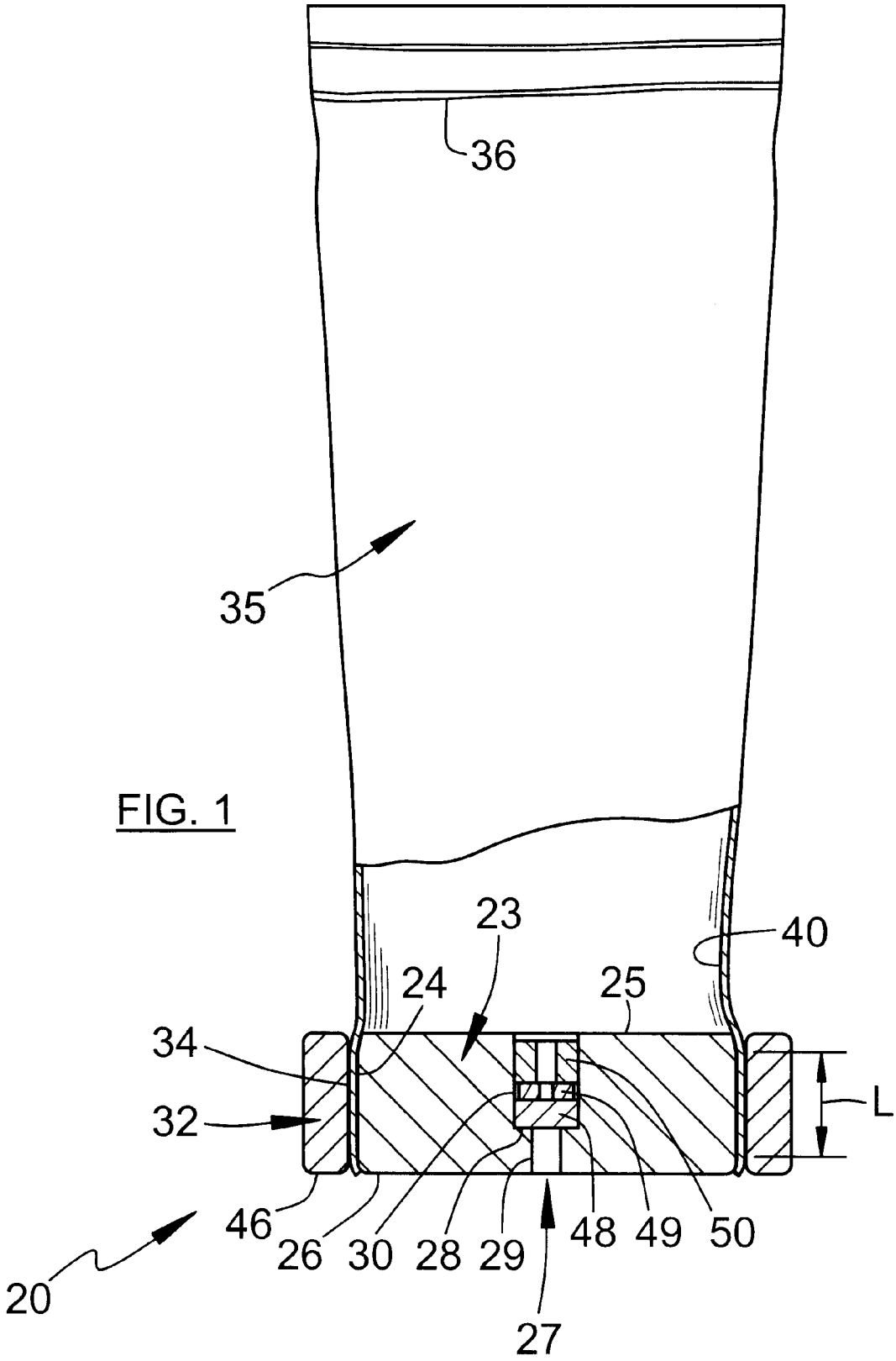
FIG. 1 is a partly-sectioned side-elevation of a replaceable ink reservoir for an ink-jet printer, which embodies the invention.

FIG. 1 shows the replaceable ink reservoir 20. A plastic plug 23 has an outer right-cylindrical surface 24 having a diameter of about 35 mm. The thickness of the plug 23 between the inside wall 25 and the outside wall 26 is 15 mm. The plug 23 is formed with a central through-hole 27, which includes a step 28 between a small diameter 29 and a larger diameter 30. The plug may be made of nylon, low-density polyethylene, etc.

A ring 32, also made of LDPE, encircles the plug 23. The ring has an inside right-cylindrical surface 34, which is complementary to the surface 24 on the plug. The axial length of the ring is approximately the same as the axial length of the plug. The ring has an annular thickness of 3.3 mm A bag 35, made of flexible plastic film, is trapped between the ring 32 and the plug 23. The tightly-gripping fit of the plastic film between the ring and the plug arises because of the interference fit therebetween. The fit is so tight that the film is mechanically locked very securely, and is so tight that liquid ink inside the bag 35 cannot escape. The bag 35 is sealed at its upper end by two heat-welded bands 36.

Figure 2:
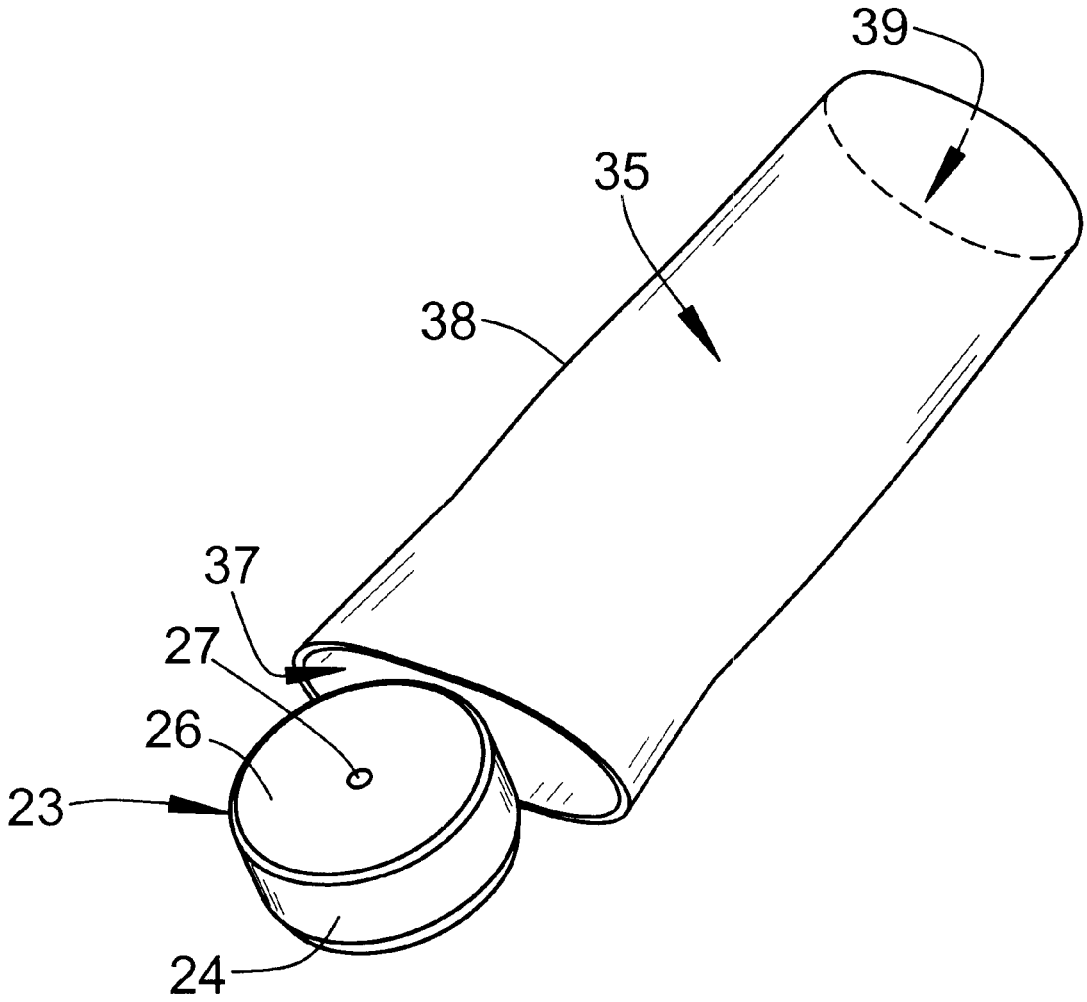
FIG. 2 is a view of some of the components of the reservoir of FIG. 1, shown at a preliminary stage of manufacture.

To assemble the reservoir 20, the following steps are carried out. First, the plug 23 is inserted into the open mouth 37 at one end of a length of plastic film tubing 38 (FIG. 2). The mouth 39 at the other end of the tubing 38 lies open also.

The plug 23 lies cross-wise in the tubing 38 at first. Upon assembly, the tubing and the plug are to be co-axial, i.e the outer right cylindrical surface 24 of the plug makes direct contact all around with the inside surface 40 of the tubing 38, as shown. The plug 23 is a tight fit in the tubing 38, whereby, in order for the inside surface 40 of the tubing to fit over the outer right cylindrical surface 24, the tubing 38 has to be stretched.

Figure 3:
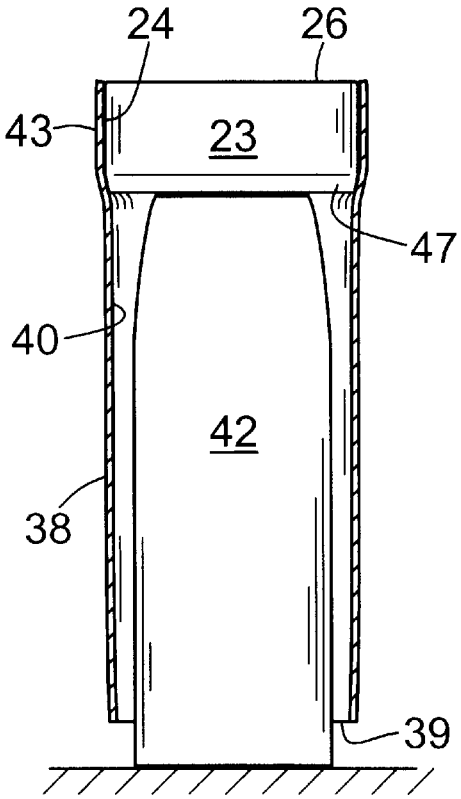
FIG. 3 is is a another view of the components of FIG. 1, shown at a later stage of manufacture.

This diametral stretching of the tubing 38 is accomplished as follows. The plug 23, having been inserted into the tubing (FIG. 2) lies cross-wise inside the tubing. The plug is then placed on a pillar 42. The plug is manipulated and orientated within the tubing until the plug lies laterally across the diameter of the tubing, whereby the plug is aligned with its axis co-axial with the axis of the tubing (FIG. 3). The force required to stretch the tubing around the plug, even though the tubing is being stretched over the surface 24 of the plug, can easily be supplied by a person's fingers, and the drawing down operation can be done by hand.

Figure 4:
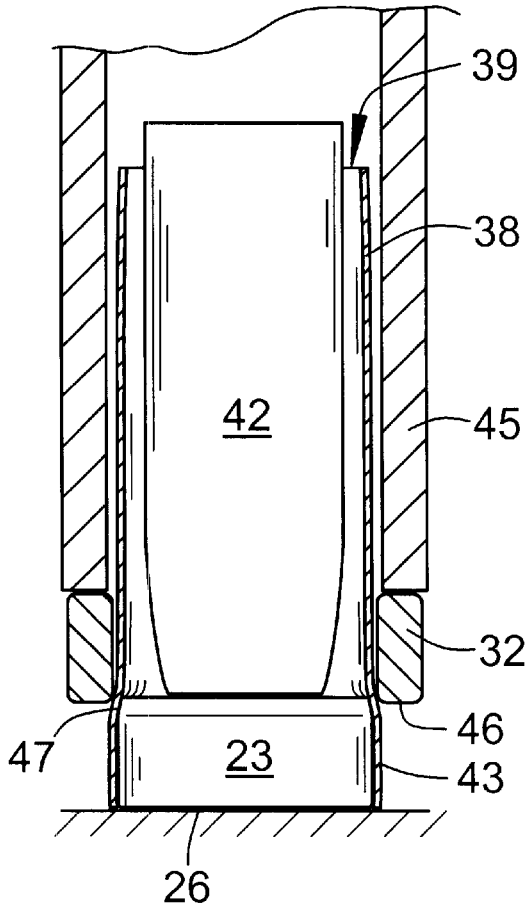
FIG. 4 is is another view of the components of FIG. 1, shown at a still later stage of manufacture.

Next, the tubing 38, stretched over the plug 23, is inverted. (It can be convenient to retain the pillar 42 inside the tubing 38 while this is done.) The ring 32 is slipped over the tubing 38. The ring is loose on the nominal diameter of the tubing, and falls down over the tubing, until the ring then lies against the portion 43 of the tubing that has been stretched over the plug 23 (FIG. 4).

An assembly sleeve 45 is brought down, which picks up the ring 32, and forces the ring to stretch over the film 43 of the tubing and over the plug. The sleeve 45 presses the ring all the way down until the face 46 of the ring lies more or less flush with the outside wall 26 of the plug.

With the ring 32 fully assembled over the plug 23, any portion of the tubing film that might be protruding beyond the wall 26 is trimmed off (with a knife). It can happen sometimes that virtually no film protrudes after assembly; sometimes several millimeters of tubing protrudes, and need to be trimmed.

The tubing having been filled with ink (through the mouth 39), the mouth 39 is sealed by heat-welding, at 36, and the reservoir 20 is ready for shipment and sale.

The various corners and junctions of the plug and ring should be chamfered, as at 47, to ease assembly and to enable the film to engage and slide thereover.

The amount of stretching of the plastic film of the tubing is important. The stretching has to be substantial enough that every hint of a wrinkle in the film material is taken out. It has been found that even the slightest wrinkle in the film can lead to a weakness or lack of tightness in the fit, at which a leakage might develop at some time in the future. The tubing should be so dimensioned that it undergoes a stretch of at least 5 or 10 percent of diameter.

Also, to ensure a reliably sealed and mechanically secure joint, it has been found that an interference fit of the ring over the diameter of the tubing stretched over the plug should be about 0.75 mm (on a diameter of 35 mm). That is to say; the inside surface 34 of the ring should be a 0.75 mm diametral interference on the overall diameter of the plug with the tubing film stretched thereover. That interference figure is the preferred minimum: the designer should provide additional interference to take account of the inevitable manufacturing tolerances and inaccuracies.

To assemble the reservoir into the printer, the ink-receiving needle (which is a fixture of the printer) is inserted through the hole 27 of the plug 23. Contained in the larger diameter receptacle 30 is a pierceable membrane 48, surmounted by a stainless steel washer 49. These items are retained in the hole by an insert 50, made of e.g brass. The insert 50 preferably is barbed on its outside surface, to ensure the components cannot come out of the hole 27. The insert should be inserted firmly enough to ensure that the membrane 48 is held slightly compressed against the step 28, since the membrane serves not only to seal around the needle, but serves also to seal the through-hole 27.

The outward-facing surface 24 on the plug, and the complementary inward-facing surface 34 on the ring, have been indicated as right-cylindrical—that is to say: not tapered. However, while that particular configuration is preferred, other shapes, including tapered, are contemplated. The key requirement is that the ring remain tightly gripped around the plug, with the film nipped and gripped securely therebetween. But right-cylindrical is preferred, in that any shape other than right-cylindrical might compromise the effectiveness of stretching the tubing over the plug, aimed at smoothing out wrinkles. Only the right-cylindrical form gives an even stretch (assuming the tubing is itself right-cylindrical).

The coefficient of friction of plastic on plastic can be rather low, and since the grip of the bag between the plug and the ring depends on friction, it is important that the grip be very tight. It is important that the engagement length L, over which the bag material is gripped between the plug and the ring, be quite long: a length of 1 cm has been found to give an adequate grip. Any lead-in chamfers, as at 47, are not included in the length L.

What is claimed is:

1. Ink-storage reservoir apparatus for a printer, wherein:

the apparatus includes a bag of flexible plastic film;

the apparatus includes a plug, which serves to close a mouth of the bag;

the mouth of the bag is defined by an encircling lip of the felxible plastic film;

the lip is uniform in thickness, around the mouth of the bag;

the plug has an outward-facing surface;

the apparatus includes a membrane, which can be pierced by, and seal around, a sharp hollow needle;

the dimensions of the outward-facing surface of the plug, in relation to the dimensions of the mouth of the bag, are such that, in order for the mouth to be fitted over the plug, the lip of film that defines the mouth of the bag must be stretched;

the said lip lies stretched over the outer surface of the plug;

the apparatus includes a ring, and the ring has an inward-facing surface, which is complementary to the outward-facing surface of the plug;

the inward-facing surface of the ring, and the outward-facing surface of the plug, are substantially circular in form, their circular forms being concentric;

the dimensions of the ring, in relation to the dimensions of the plug and of the lip of film that defines the mouth of the bag when the lip lies stretched over the outer surface of the plug, are such that the ring is a tight interference fit over the lip of film when the lip is stretched over the outer surface of the plug;

the ring lies pressed over the lip, and over the plug, and encircles the plug;

whereby the lip of film that defines the mouth of the bag is sealed and gripped, tightly and securely, between the outward-facing surface of the plug and the inward-facing surface of the ring;

the ring is of a relatively rigid plastic material, and is annular in form, and its form is characterised as thick and chunky;

the tightness of the interference fit between the plug and the ring, the said lip of film being trapped therebetween, is such that the bag and the ring are held firmly and securely to the plug by friction induced by the tight fit;

the interference fit between the plug and the bag and between the plug and the ring is uniform as to the tightness of the fit, around the mouth of the bag.

2. Apparatus of claim 1, wherein the outward-facing surface of the plug and the inward-facing surface of the ring are complementarily right-cylindrical over a length L.

3. Apparatus of claim 1, wherein the plug is of plastic material, and is in the form of a thick disk, and its form is characterised as thick and chunky.

4. Apparatus of claim 1, wherein the membrane is mounted in a receptacle in the plug.

5. Apparatus of claim 1, wherein the dimensions of the outward-facing surface of the plug, in relation to the dimensions of the lip of film that defines the mouth of the bag, are such that, in order for the mouth to be fitted over the plug, the lip must be stretched over the outward-facing surface of the plug to the extent that the stretched lip is smooth and wrinkle free.

6. Apparatus of claim 1, wherein the apparatus is free of adhesive between the plug and the bag, and between the bag and the ring.

7. Apparatus of claim 1, wherein the interference fit between the plug and the bag and between the bag and the ring is present over a substantial length of engagement L.

8. Apparatus of claim 7, wherein the length of engagement L is at least 1 cm.

9. Apparatus of claim 1, wherein the plug and ring are formed with chamfers, which are so positioned as to enable the plug and ring to slide easily axially in male-female engagement, relative to the lip of film that defines the mouth of the bag being positioned therebetween.

10. Apparatus of claim 1, wherein the interference of the tight interference fit between the inside-facing surface of the ring, and the lip of film that defines the mouth of the bag stretched over the outward-facing surface of the plug, is approximately 0.75 mm.

11. Apparatus of claim 1, wherein the apparatus is an apparatus which has been manufactured according to the following procedure:

the plug was placed inside the mouth of the bag;

the plug, inside the bag, was placed against a pillar;

the bag was in the form of a length of tubing, having an axis;

the bag was drawn over the pillar, the plug lying on the pillar and being aligned thereby perpendicular to the axis;

the ring was placed over the bag;

and the ring was pressed hard over the plug, and over the mouth of the bag stretched thereover.

12. Apparatus of claim 1, wherein:

the dimensions of the outward-facing surface of the plug, in relation to the dimensions of the lip of film that defines the mouth of the bag, are such that; in order for the mouth to be fitted over the plug, the lip must be stretched over the outward-facing surface of the plug to the extent that the stretched lip is smooth and wrinkle-free;

the interference fit between the plug and the bag and between the bag and the ring is present over a substantial length of engagement L;

the outward-facing surface of the plug and the inward-facing surface of the ring are complementarily right-cylindrical over the length L;

the plug and ring are formed with chamfers, which are so positioned as to enable the plug and ring to slide easily axially in male-female engagement, relative to the lip of film that defines the mouth of the bag being positioned therebetween.

13. Apparatus of claim 12, wherein the plug is of plastic material, and is in the form of a thick disk, and its form is characterised as thick and chunky;

the membrane is mounted in a receptacle in the plug;

the apparatus is free of adhesive between the plug and the bag, and between the bag and the ring.

14. As in claim 12, wherein the length of engagement L is at least 1 cm;

the interference of the tight interference fit between the inside-facing surface of the ring, and the lip of film that defines the mouth of the bag stretched over the outward-facing surface of the plug, is approximately 0.75 mm.

* * * * *